US011545744B2

(12) United States Patent
Radey

(10) Patent No.: US 11,545,744 B2
(45) Date of Patent: Jan. 3, 2023

(54) DECORATIVE ANTENNA

(71) Applicant: Charles Radey, Folsom, CA (US)

(72) Inventor: Charles Radey, Folsom, CA (US)

( * ) Notice: Subject to any disclaimer, the term of this patent is extended or adjusted under 35 U.S.C. 154(b) by 66 days.

(21) Appl. No.: 17/186,680

(22) Filed: Feb. 26, 2021

(65) Prior Publication Data

US 2022/0278447 A1 Sep. 1, 2022

(51) Int. Cl.
*H01Q 1/32* (2006.01)
*H01Q 1/44* (2006.01)
*H01Q 1/12* (2006.01)

(52) U.S. Cl.
CPC ..... *H01Q 1/44* (2013.01); *H01Q 1/1242* (2013.01); *H01Q 1/3275* (2013.01)

(58) Field of Classification Search
CPC ..... H01Q 1/44; H01Q 1/1242; H01Q 1/3275; H01Q 1/12; H01Q 1/32; H01Q 9/30; H01Q 9/32; H01Q 1/24; H01Q 1/36
See application file for complete search history.

(56) References Cited

U.S. PATENT DOCUMENTS 3,268,897 A * 8/1966 Link ..... H01Q 1/3275 343/749
4,086,596 A * 4/1978 Gauss ..... H01Q 9/30 343/715
4,223,314 A * 9/1980 Tyrey ..... H01Q 1/1214 343/715
4,238,800 A * 12/1980 Newington ..... H01Q 9/30 343/715
5,343,214 A * 8/1994 Hadzoglou ..... H01Q 1/1285 343/846
5,856,807 A * 1/1999 Davis ..... H01Q 9/32 343/702
7,053,860 B1 * 5/2006 Guo ..... H01Q 1/1207 343/900
2020/0091580 A1 * 3/2020 Katzin ..... H01Q 1/12

* cited by examiner

*Primary Examiner* — Tho G Phan
(74) *Attorney, Agent, or Firm* — AU LLC; Adam E. Urbanczyk

(57) ABSTRACT

Disclosed is a decorative antenna having an antenna body, a first cap, a first decorative sleeve, a second cap, and a second decorative sleeve. The antenna body includes an internal cavity extending from a proximal end towards a distal end, and a mast portion between the distal end and the proximal end. The first cap is adapted to removably secure against the distal end. The first decorative sleeve is adapted to be removably placed over the first decorative surface. The second cap includes a second decorative surface. The second cap is adapted to be removably secured against the distal end. The second cap is adapted to removably receive the securing portion. The second cap is adapted to removably secure against a signal source and maintain electrical communication between the signal source and the securing portion. The second decorative sleeve is adapted to be removably placed over the second decorative surface.

14 Claims, 3 Drawing Sheets

DECORATIVE ANTENNA

BACKGROUND OF THE INVENTION

Field of the Invention

The present invention generally relates to a decorative antenna, and more particularly relates to a modular decorative antenna with replaceable tip and features to allow a user to visually distinguish the antenna and thus the car from which the antenna sprouts.

Description of Related Art

Automobiles are the second homes for many automobile owners. Therefore, many ornaments are used by the owners to decorate their automobiles. Most of these ornaments are used inside the automobiles, which could only be enjoyed by the owners but not be shared by the others and just serves the function of decorating.

In addition, because the automobiles models, beyond paint color, have similar external features, it can be difficult for the owners to distinguish and find their automobiles in large parking lots (indoor or outdoor) at night or on foggy days which have lower visibility.

A typical example of a conventional FM broadcast signal receiving antenna for an automobile is a whip antenna adapted to be installed on the front part, the roof, or the trunk of an automobile. The antenna came with a fixed color tip that was not interchangeable. Thus there is a need of an antenna that allows interchangeable tip.

SUMMARY OF THE INVENTION

In accordance with teachings of the present invention a decorative antenna is provided. An object of the invention is to provide a decorative antenna having an antenna body, a first cap, a first decorative sleeve, a second cap, and a second decorative sleeve. The antenna body includes an internal cavity extending from a proximal end towards a distal end, and a mast portion between the distal end and the proximal end. The internal cavity is adapted to fixably receive a coil body.

The coil body includes a wire coil in electrical communication with a securing portion. The securing portion is extending out from the proximal end when the coil body is fixed within the internal cavity. The distal end includes a first lip. The distal end further includes a first decorative surface distally proximate to the first lip.

The first cap is adapted to removably secure against the distal end. The first decorative sleeve is adapted to be removably placed over the first decorative surface between the first lip and the first cap. The second cap includes a second decorative surface. The second cap further includes a second lip.

The second cap is adapted to be removably secured against the distal end. The second cap is adapted to removably receive the securing portion. The second cap is adapted to removably secure against a signal receiver and maintain electrical communication between the signal receiver and the securing portion. The second decorative sleeve is adapted to be removably placed over the second decorative surface between the second lip and the proximal end.

Another object of the present invention is to provide the antenna body with a circular cross section. Further, the cross-sectional diameter of the mast portion decreases from the proximal end to the distal end. Further, the antenna body is made from a non-conductive rubber material.

Another object of the present invention is to provide the antenna body wherein the proximal end has at least one proximal groove disposed onto the surface of the proximal end, and the distal end is having at least one distal groove disposed onto the first decorative surface.

Another object of the present invention is to provide the first cap with a threaded shaft. The distal end further includes a socket adapted to receive the threaded shaft. The securing portion is a threaded shaft. A bore extends through the entire length of the second cap.

Another object of the present invention is to provide the decorative antenna wherein the signal receiver is a vehicle radio system antenna plug extending from the surface of the vehicle. Further, the non-conductive rubber material is ethylene propylene diene monomer rubber.

Another object of the present invention is to provide the decorative antenna wherein the non-conductive rubber material is ethylene propylene diene monomer rubber, wherein the at least one proximal groove is adapted to secure a decorative ring around the circumference of the antenna body.

Another object of the present invention is to provide the decorative antenna wherein the at least one distal groove is disposed onto the first decorative surface to secure the first decorative sleeve. Further, the distal groove is adapted to secure a decorative ring onto the first decorative surface.

While a number of features are described herein with respect to embodiments of the inventions; features described with respect to a given embodiment also may be employed in connection with other embodiments. The following description and the annexed drawings set forth certain illustrative embodiments of the inventions. These embodiments are indicative, however, of but a few of the various ways in which the principles of the inventions may be employed. Other objects, advantages, and novel features according to aspects of the inventions will become apparent from the following detailed description when considered in conjunction with the drawings.

BRIEF DESCRIPTION OF THE DRAWINGS

The annexed drawings, which are not necessarily to scale, show various aspects of the inventions in which similar reference numerals are used to indicate the same or similar parts in the various views.

DETAILED DESCRIPTION OF THE INVENTION

Figure 1:
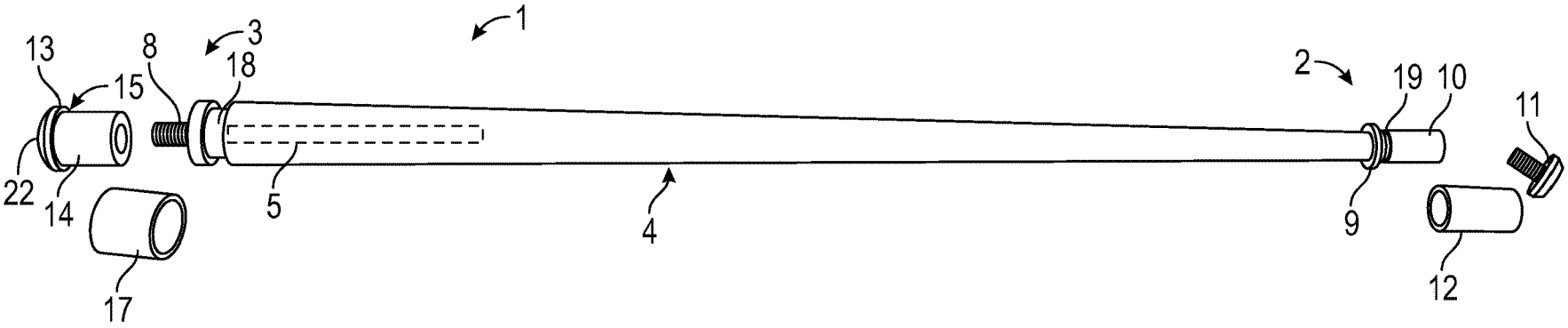
FIG. 1 illustrates an exploded view of a decorative antenna.

While this technology is illustrated and described in a preferred embodiment a decorative antenna for vehicular applications may be produced in many different configurations, forms and materials. There is depicted in the drawings, and will herein be described in detail, as a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the technology described herein.

These and similar directional terms should not be strictly construed to limit the scope of the invention. In addition, words such as attached, affixed, coupled, connected and similar terms with their inflectional morphemes are used interchangeably, unless the difference is noted or made otherwise clear from the context. These words and expressions do not necessarily signify direct connections, but include connections through mediate components and devices.

The present disclosure is now described in detail with reference to the drawings. In the drawings, each element with a reference number is similar to other elements with the same reference number independent of any letter designation following the reference number. In the text, a reference number with a specific letter designation following the reference number refers to the specific element with the number and letter designation and a reference number without a specific letter designation refers to all elements with the same reference number independent of any letter designation following the reference number in the drawings.

FIG. 1 illustrates an exploded view of the decorative antenna. The decorative antenna includes an antenna body 1, a first cap 11, a first decorative sleeve 12, a second cap 13, and a second decorative sleeve 17. The antenna body 1 includes a distal end 2, a proximal end 3 and a mast portion 4 extended between the distal end 2 and the proximal end 3.

The antenna body 1 has an internal cavity 5 extending from the proximal end 3 towards the distal end 2. The distal end 2 is having a first lip 9 and a first decorative surface 10 distally proximate to the first lip 9. The first cap 11 is adapted removably secure against the distal end 2. The first decorative sleeve 12 is adapted to be removably placed over the first decorative surface 10 between the first lip 9 and the first cap 11.

The second cap 13 has a second decorative surface 14 and a second lip 15. The second cap 13 is adapted to be removably secured against the proximal end 3. The second cap 13 is adapted to removably receive the securing portion 8.

The second cap 13 is adapted to removable secure against a signal receiver (16, SHOWN IN FIG. 2) and maintain electrical communication between the signal receiver and the securing portion 8. The second decorative sleeve 17 is adapted to be removably placed over the second decorative surface 14 between the second lip 15 and the proximal end 3.

Figure 2:
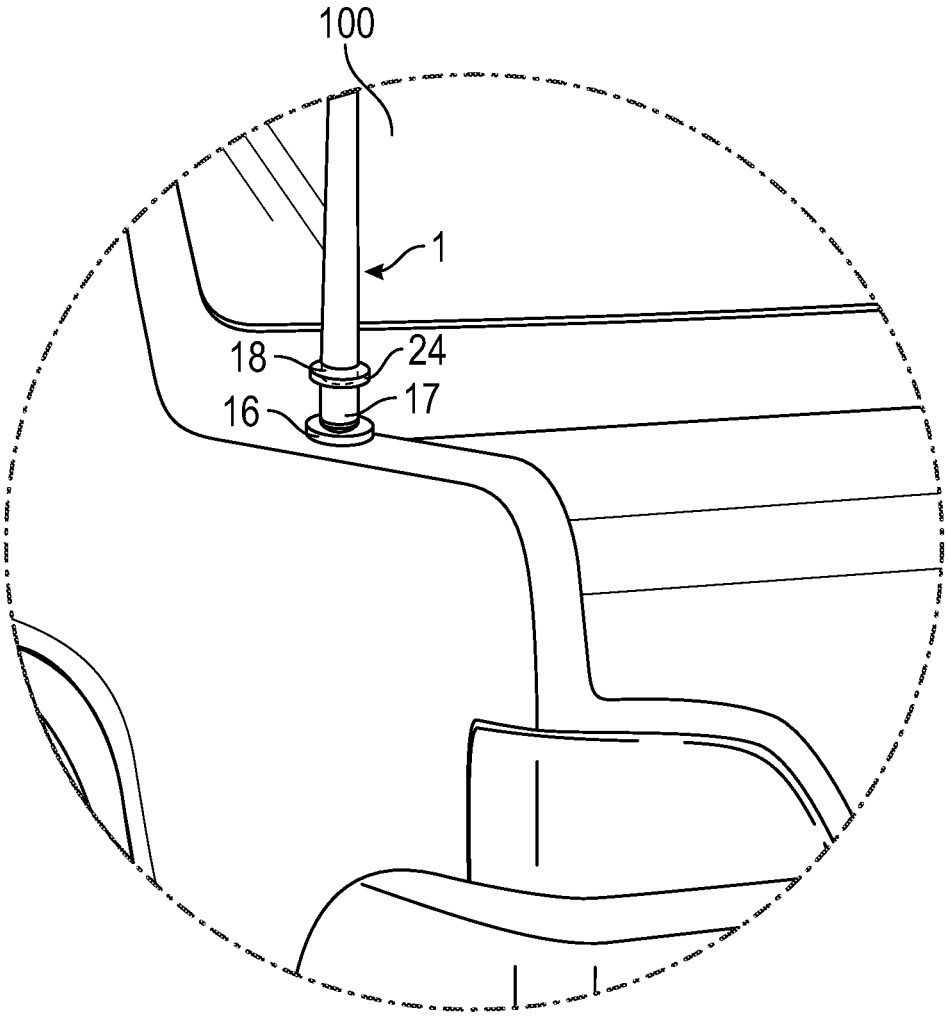
FIG. 2 illustrates a zoom view of a decorative antenna installed on a car.

FIG. 2 illustrates a zoom view of a decorative antenna installed on a car 100. The first decorative sleeve 12 and the second decorative sleeve 17 are replaceable. The decorative antenna 1 allows easy replacement of the first decorative sleeve 12 and the second decorative sleeve 17.

Thus a user is able to place a preferred color decorative sleeve 12, 17 to enhance/match the appearance of the decorative antenna 1. It would be readily apparent to those skilled in the art that various types of color may be envisioned for the first decorative sleeve 12 and the second decorative sleeve 17.

In exemplary embodiments of the present invention, the color decorative sleeves 12,17 allow the user to match with clothes, wearable accessories etc. and further decorative sleeves 12, 17 allow the user to identify their vehicles in large parking spaces. It would be readily apparent to those skilled in the art that the decorative sleeves 12,17 may be used for various purposes without deviating from the scope of the present invention.

The signal receiver 16 is, for example, a vehicle radio system antenna plug extending from the surface of the vehicle 100. Further, a proximal groove 18 is adapted on the proximal end 3 to secure a decorative ring 24 around the circumference of the antenna body. The decorative ring 24 increases the aesthetic value of the antenna. Further, the decorative ring 24 or another may be secured on the distal groove 19.

Figure 3:
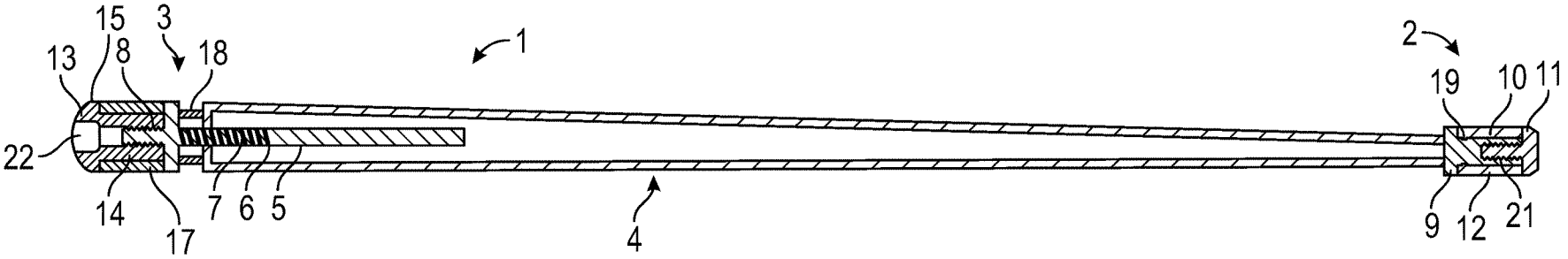
FIG. 3 illustrates a cross-section view of the decorative antenna.

FIG. 3 illustrates a cross-section view of the decorative antenna. The cross-section view showcase the attachments of the coil body 6 extending from the proximal end 3 towards the distal end 2. The first decorative surface 10 is distally proximate to the first lip 9. The first cap 11 is removable secure against the distal end 2 through the first decorative surface 10 under the first decorative sleeve 12.

Similarly, the second decorative surface 14 is distally proximate to the second lip 15. The second cap 13 is removably secured against the proximal end 3. The securing portion 8 is received into a bore 22 of the second cap 13. The securing position 8 is, for example, a threaded shaft. The internal cavity is adapted to fixably receive a coil body 6. The coil body 6 comprises a wire coil 7 in electrical communication with the securing position 8. The securing position 8 extends out from the proximal end 3 when the coil body 6 is fixed within the internal cavity 5.

The first cap 11 includes a shaft (20, shown in FIG. 4) to be placed inside a socket 21. Similarly, the second cap 13 holds the second decorative sleeve 17 in its place. It would be readily apparent to those skilled in the art that various shapes and sizes of the first cap 11, the second cap 13, the first decorative sleeve 12 and the second decorative sleeve 17 may be envisioned without deviating from the scope of the present invention.

In another embodiment of the present invention, the antenna body 1 has a circular cross-section. Further, the cross-sectional diameter of the mast portion 4 decreases from the proximal end 3 to the distal end 4. The antenna body 1 is made from a non-conductive rubber material. An example of a non-conductive rubber material is ethylene propylene diene monomer rubber.

Further, the proximal end 3 has at least one proximal groove 18 which is disposed onto the surface of the proximal end 3. Similarly, the distal end 2 has at least one distal groove 19 disposed onto the first decorative surface 10 to help secure the first decorative sleeve 12. In another embodiment of the present invention, the decorative antenna 1 includes a bore 22 that extends through the entire length of the second cap 13.

Figure 4:
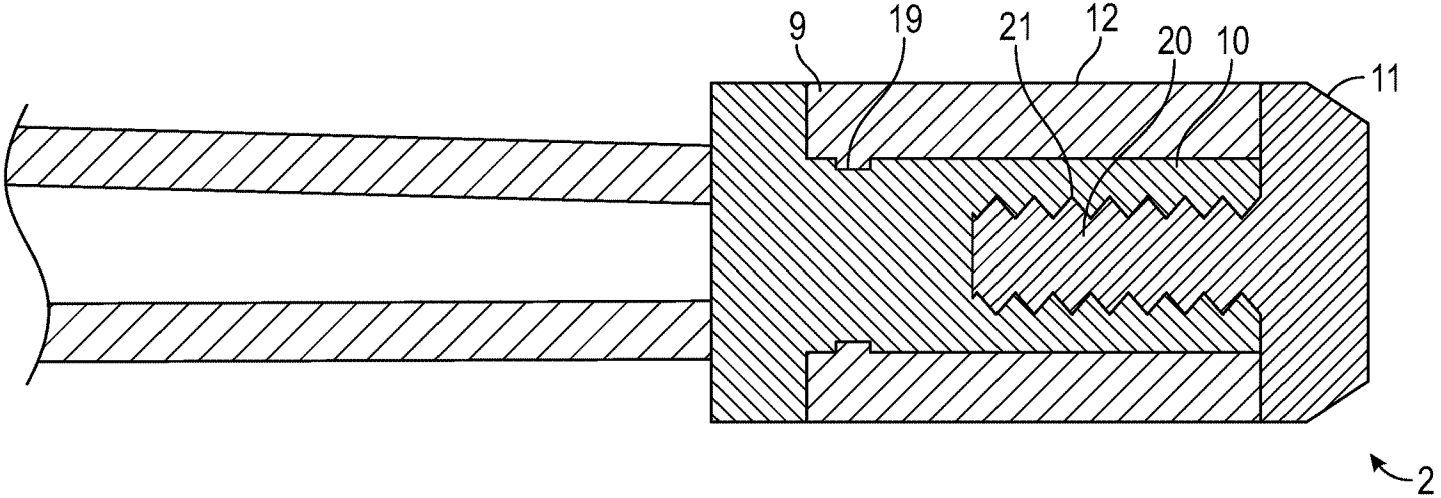
FIG. 4 illustrates a cross sectional view of the distal end of a decorative antenna.

FIG. 4 illustrates a cross sectional view of the distal end 2 of the decorative antenna. The first cap 11 includes a threaded shaft 20. The distal end 2 further includes a socket 21 adapted to receive the threaded shaft 20.

The distal groove 19 is disposed onto the first decorative surface 10 to help secure the first decorative sleeve 12. The first decorative sleeve 12 is secured between the first cap 11 and the first lip 9.

The present invention offers various advantages such as a decorative antenna having replaceable components to increase aesthetic value. The decorative antenna offers replaceable top and bottom sleeves to bring in color variation to the antenna. The present invention allows users to choose several different colors and the change the color of the tip or base with an added color kit through quick removal of the antenna from a vehicle and quick disassembly and reassembly of the invention's component parts.

Thus is it will be seen that there is provided a decorative antenna for automotive vehicular applications which achieves the various aspects, features and considerations of the present invention and which is well suited to meet the conditions of practical usage. While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

The invention claimed is:

1. A decorative antenna, the decorative antenna comprising:

an antenna body, the antenna body having a distal end, a proximal end, and a mast portion between the distal end and the proximal end, the antenna body further having an internal cavity extending from the proximal end towards the distal end, the internal cavity adapted to fixably receive a coil body, the coil body comprising wire coil in electrical communication with a securing portion, the securing portion extending out from the proximal end when the coil body is fixed within the internal cavity, the distal end having a first lip, the distal end further having a first decorative surface distally proximate to the first lip;

a first cap adapted to removably secure against the distal end distally proximate the first decorative surface;

a first decorative sleeve adapted to be removably placed over the first decorative surface and secured between the first lip and the first cap when the first cap is secured against the distal end;

a second cap having a second decorative surface, the second cap further having a second lip, the second cap adapted to be removably secured against the distal end, the second cap having a bore adapted to removably receive the securing portion, the second cap adapted to removably secure against a signal receiver and maintain electrical communication between the signal receiver and the securing portion;

a second decorative sleeve adapted to be removably placed over the second decorative surface between the second lip and the proximal end.

2. The decorative antenna of claim 1, wherein the antenna body has a circular cross section.

3. The decorative antenna of claim 1, wherein the cross sectional diameter of the mast portion decreases from the proximal end to the distal end.

4. The decorative antenna of claim 1, wherein the antenna body is made from a non-conductive rubber material.

5. The decorative antenna of claim 4, wherein the non-conductive rubber material is ethylene propylene diene monomer rubber.

6. The decorative antenna of claim 1, wherein the proximal end has at least one proximal groove disposed onto the surface of the proximal end.

7. The decorative antenna of claim 6, wherein the at least one proximal groove is adapted to secure a decorative ring around the circumference of the antenna body.

8. The decorative antenna of claim 1, wherein the distal end has at least one distal groove disposed onto the first decorative surface.

9. The decorative antenna of claim 8, wherein the at least one distal groove is disposed onto the first decorative surface to secure the first decorative sleeve.

10. The decorative antenna of claim 8, wherein the at least one distal groove is adapted to secure a decorative ring onto the first decorative surface.

11. The decorative antenna of claim 1, wherein the first cap further comprises a threaded shaft, wherein the distal end further comprises a socket adapted to receive the threaded shaft.

12. The decorative antenna of claim 1, wherein the securing portion is a threaded shaft.

13. The decorative antenna of claim 1, wherein the bore extends through the entire length of the second cap.

14. The decorative antenna of claim 1, wherein the signal receiver is a vehicle radio system antenna plug extending from the surface of the vehicle.

* * * * *